US005086696A

United States Patent [19]

Junghans

[11] Patent Number: 5,086,696

[45] Date of Patent: Feb. 11, 1992

[54] WETTING/INKING MECHANISM FOR OFFSET PRINTING PRESSES

[75] Inventor: Rudi Junghans, Wilhelmsfeld, Fed. Rep. of Germany

[73] Assignee: Heidelberger Druckmaschinen AG, Heidelberg, Fed. Rep. of Germany

[21] Appl. No.: 497,443

[22] Filed: Mar. 22, 1990

Related U.S. Application Data

[63] Continuation-in-part of Ser. No. 288,790, Dec. 22, 1988, Pat. No. 4,922,818.

[30] Foreign Application Priority Data

Apr. 5, 1989 [DE] Fed. Rep. of Germany ... 8904197[U]

[51] Int. Cl.[5] ..... B41F 7/26; B41F 7/36

[52] U.S. Cl. ..... 101/148; 101/349

[58] Field of Search ..... 101/148, 147, 348, 349, 101/350, 351, 352, 363, 207-210

[56] References Cited

U.S. PATENT DOCUMENTS

| | | | |
|---|---|---|---|
| 3,118,373 | 1/1964 | Mosemiller | 101/348 |
| 4,351,236 | 9/1982 | Beisel et al. | 101/148 |
| 4,407,197 | 10/1983 | Jeschke | 101/349 X |
| 4,722,274 | 2/1988 | Jeschke et al. | 101/349 X |
| 4,724,764 | 2/1988 | MacPhee | 101/349 X |

FOREIGN PATENT DOCUMENTS 2093771 9/1982 United Kingdom .

*Primary Examiner*—J. Reed Fisher

*Attorney, Agent, or Firm*—Nils H. Ljungman & Associates

[57] ABSTRACT

Roller for distributing at least one of an ink and a wetting agent in a printing press. The roller has a generally uniform roughness of about fifteen micrometers to about twenty micrometers over its entire exterior surface.

15 Claims, 4 Drawing Sheets

WETTING/INKING MECHANISM FOR OFFSET PRINTING PRESSES

CROSS REFERENCE RELATED TO APPLICATION

This application is a continuation-in-part application of application Ser. No. 07/288,790 (NHL-HBD-14), filed Dec. 22, 1988, now U.S. Pat. No. 4,922,818.

BACKGROUND OF THE INVENTION

1. Field of the Invention

The present invention relates to a wetting/inking mechanism for offset printing presses that have a plurality of applicator rolls which correspond to a plate cylinder, the first and second applicator rolls of which, when viewed in the direction of rotation of the plate cylinder, are connected to one another by means of an ink distributing roller. The printing press also has a dip roller which is located in a wetting agent tank, which is in contact which a dosing roller, and which is mounted so that it can move into contact with the first applicator roll.

The disadvantage of known wetting/inking mechanisms which are configured in this manner is that, in all the different inking processes, the wetting agent is transported to the first applicator roll, seen in the direction of rotation of the plate cylinder, and by means of contact between the first ink applicator roll and the distributing roller, ink and wetting agent are always being transferred to the printing plate. As a result, build-up and overflow of ink and/or wetting agent can occur.

Also, the present invention relates to a roller in a printing unit of a rotary printing machine in which the entire outer cylindrical surface of the roller has a uniform roughness.

2. Background Information

German Patent No. 31 46 223 describes a wetting-/inking mechanism for offset printing presses in which there are a total of five applicator rolls for the plate cylinder, the first and second rolls of which, seen in the direction of rotation of the plate cylinder, are connected by means of an intermediate roller. In this device, the wetting mechanism works together with the first applicator roll. The large number of applicator rolls utilized in this design clearly increases its manufacturing costs. German Laid Open Patent Appln. No. 29 32 105 describes a wetting/inking mechanism in which the first applicator roll, seen in the direction of rotation of the plate cylinder, the distributing roller working together with it, and the dip roller immersed in the wetting agent tank, are mounted in a separate frame. By pivoting this separate frame, the distributing roller can be pivoted toward or away from the second applicator roll. This design already makes possible a separation between the wetting mechanism and the inking mechanism for the processing of certain jobs. However, the design is significantly complex and expensive to implement.

German Patent Publication Published for Opposition Purposes No. 24 32 576 describes rollers having rough outer cylindrical surfaces. However, these rollers are used as wetting distributor rollers in a wetting unit of an offset printing machine. These wetting distributor rollers are used to uniformly distribute wetting medium film. The roughness of the outer cylindrical surface of the wetting distributor roller is designed to prevent the wetting medium from accumulating before the point at which the wetting distributor roller contacts other rollers cooperating therewith. Therefore, the rough outer cylindrical surface of the wetting distributor roller is employed only to ensure a continuous wetting-medium supply, to achieve a uniform wetting-medium film.

OBJECT OF THE INVENTION

One object of the present invention is the provision of a wetting/inking mechanism which can work with an alcohol additive in the wetting agent, such that, even with a narrow printed web, or when printing a small paper format, the buildup of wetting agent leading to the formation of an emulsion with the ink is prevented, and such that a buildup of ink and smearing is significantly reduced.

Another object of the present invention is to reduce the ghosting tendency of the inking/dampening unit of an offset printing press, even with little inking, and to eliminate mechanical influences and resultant problems associated therewith.

SUMMARY OF THE INVENTION

These and other objects are achieved by the present invention, wherein the first applicator roll is mounted so that it can be moved away from the ink distributor roll into a second working position. In this position, the applicator roll is used only to apply the wetting agent to the plate of the plate cylinder. Therefore, a very low buildup is achieved, and practically no smearing occurs. In the first working positions, in which the applicator roll is not in contact with the ink distributor roller, small paper formats or paper printed over only part of its width can be processed without the buildup of ink and wetting agent. Accordingly, by moving the applicator roll toward and away from the ink distributor roller, it is easy for an operator to make an adjustment for special printing jobs.

In the preferred embodiment of the wetting/inking mechanism, the movable wetting rollers are provided with chromium jacket surfaces which produce an additional smoothing of the wetting agent film on the first applicator roll. In addition, as a result of the mounting of the first applicatior roll and the wetting roller on provided lever pairs, a stable and precise mounting is achieved, which can be easily adjusted.

In general, the invention features a mechanism for applying a wetting agent or ink in a printing press, the printing press including a plate cylinder, an ink reservoir and an ink transfer apparatus for transferring the ink from the ink reservoir to the plate cylinder, the ink transfer apparatus including at least a first applicator roller which receives ink from the ink reservoir, the first applicator roller being in contact with the plate cylinder, and a distributor roller, the mechanism including a second applicator roller, a wetting agent reservoir, a wetting agent transfer apparatus for transferring the wetting agent from the wetting agent reservoir to the second applicator roller, and a selective shifting apparatus for selectively shifting the second applicator roller between a first position wherein it contacts both the plate cylinder and the distributor roller and a second position wherein it contacts the plate cylinder but is not in contact with the distributor roller.

With the present invention, a roller is mounted so as to be engageable at the last wetting medium applicator roller and the first ink applicator roller, as seen in direction of rotation of the plate cylinder. The roller is provided with an outer cylindrical surface made of copper and has a roughness of 15 to 20 micrometers. With this roller, ghosting can be reduced, even with little inking, since the outer cylindrical surface of the roller makes it difficult, or impossible, for the wetting medium to escape toward the center of the machine due to contact pressure, when engaging the roller at the wetting medium applicator roller and the ink applicator roller. The use of copper and a specific roughness of the outer cylindrical surface, in the construction of the cylinder, avoids the above-recited problems and ensures a uniform wetting medium supply. Moreover, the residual wetting medium film is, advantageously worked into the ink, which helps to improve the print result. In addition, roller bending, or a change in temperature do not influence the wetting medium supply through the gap formed between the wetting medium applicator roller and first ink applicator roller, so that it is not necessary to perform any readjustments.

In an advantageous embodiment of the invention, the outer cylindrical surface is galvanically roughened and comprises, preferably, an ink-receptive material.

One aspect of the present invention resides broadly in a printing press for printing a document. The printing press includes a plate cylinder, an ink applicator roller, for being in contact with the plate cylinder and for applying an ink to the plate cylinder, a wetting medium applicator, for being in contact with the plate cylinder and for applying a wetting agent to the plate cylinder and a roller apparatus for being in contact with at least one of the ink applicator roller device and the wetting medium applicator device and for distributing at least one of the wetting agent and the ink. The roller apparatus defines an exterior surface and the exterior surface has a roughness in the range of about fifteen micrometers to about twenty micrometers.

Another aspect of the present invention resides broadly in an apparatus for distributing at least one of a wetting agent and an ink in a printing press for printing a document. The printing press has at least one plate cylinder, at least one ink applicator roller in contact with the at least one plate cylindar and at least one wetting medium applicator in contact with the at least one plate cylinder. The appatus for distributing at least one of a wetting agent and an ink includes roller apparatus for being in contact with at least one of the at least one ink applicator roller and the at least one wetting medium applicator. The roller apparatus defines an exterior surface and the exterior surface has a roughness in the range of about fifteen micrometers to about twenty micrometers.

DESCRIPTION OF THE PREFERRED EMBODIMENTS

Figure 1:
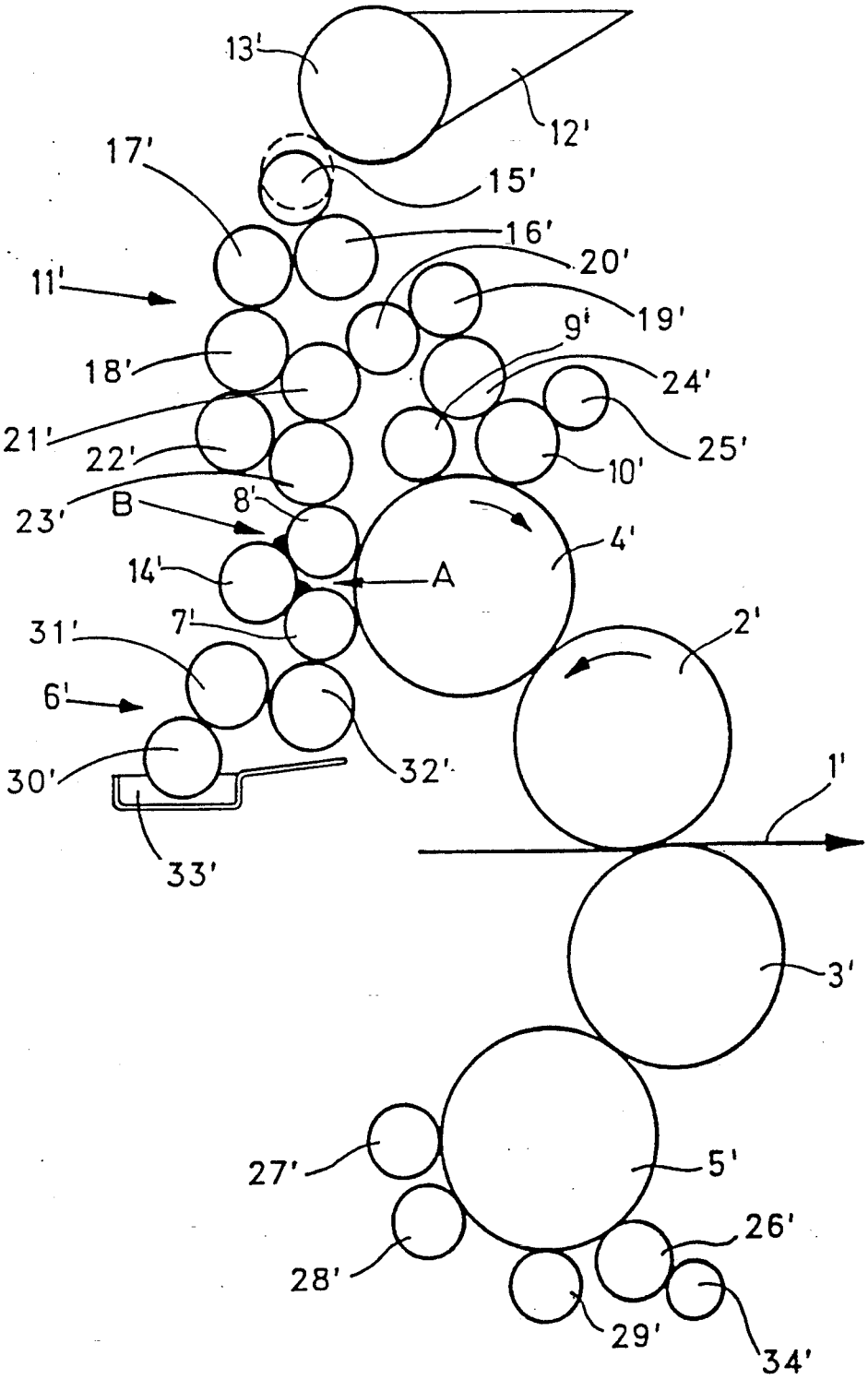
FIG. 1 is a side view of a preferred embodiment of the present invention.

In FIG. 1, paper web 1' is threaded between two blanket cylinders, 2' and 3', and printed. The printing image is transferred from plate cylinders 4' and 5' onto blanket cylinders 2' and 3' in a known manner. Plate cylinders 4' and 5' are dampened or wetted by a dampening, or wetting, applicator roller 7' of dampening unit 6'. Dampening unit 6' comprises rollers 7', 30', 31' and 32'. Roller 30' receives the wetting agent from wetting agent tank 33'. Roller 30' then applies the wetting agent to roller 31' and roller 31' then applies the wetting agent to roller 32'. Roller 7' receives the wetting agent from roller 32'.

Thereafter ink applicator rollers 8', 9' and 10' ink the printing form. Inking roller group 11' supplies ink applicator rollers 8', 9' and 10' with the ink necessary for printing.

Inking roller group 11', preferably, includes eleven rollers 15', 16', 17', 18', 19', 20', 21', 22', 23', 24' and 25' for distributing the ink from ink fountain 12'. The relative positioning of the rollers in inking roller group 11', as shown in FIG. 1, provides one advantageous configuration for properly supplying and distributing the ink from ink fountain 12'. Ink fountain 12' stores the ink which is applied onto ink fountain roller 13' in a metered manner.

Roller 15' is movable between roller 13' and roller 16'. Roller 15' receives ink from fountain roller 13' and applies the ink to roller 16'. Roller 16' then applies the ink to roller 17'. Roller 17', in turn, applies the ink to roller 18'. Roller 18' is positioned to be in contact with, and apply ink to, rollers 21' and 22'. Roller 21' is in direct contact with rollers 23' and 20'. Roller 19' is in direct contact with rollers 20' and 24'. Roller 25' is in direct contact with roller 10'. Roller 23' is in direct contact with roller 21' and 22'. Rollers 26', 27', 28' and 29' are all in direct contact with plate cylinder 5'. Roller 34' is in direct contact with roller 26'.

The portion of the printing press below paper web 1' may be symmetrical with the portion above paper web 1'. That is, the portion of the printing press below paper web 1' may include a set of rollers, an ink fountain and a wetting agent tank identical to those shown above paper web 1'.

As seen in direction of rotation of plate cylinders 4' and 5', roller 14' is engaged at the last wetting medium applicator roller 7' and at the first ink applicator roller 8'. Roller 14' is mounted in a known manner via pivoting levers and sliding bearings (not shown). Roller bending results in a contact pressure which is higher in the boundary areas than it is in the middle so that the dampening or wetting medium is squeezed out of these boundary areas. This brings about a scumming effect in the print and a ghosting effect after an increased wetting medium supply. The outer cylindrical surface of roller 14' consists, preferably, of copper and features a roughness of 15 and 20 micrometers. The roughness is preferably measured from peak to valley and may be an average roughness of the peak to valley distances or a measurement of the peak-to-peak distances. It is also conceivable to provide the rollers with other ink-receptive outer cylindrical surfaces which are also galvanically roughened and may e.g. be made of bronze, brass or the like.

With the present invention, the wetting medium is prevented from accumulating in gap A and from escaping laterally. Furthermore, the present invention makes it possible to work the wetting medium, which has accumulated in gap B, into ink on the ink applicator roller 8', thus improving the print result. In so doing, the ghosting tendency of the inking/wetting unit is reduced considerably and mecahanical influences, such as e.g. engagement of the roller under high pressure of bending of the rollers are eliminated, thus also, reducing scumming and ghosting under these circumstances.

Figure 2:
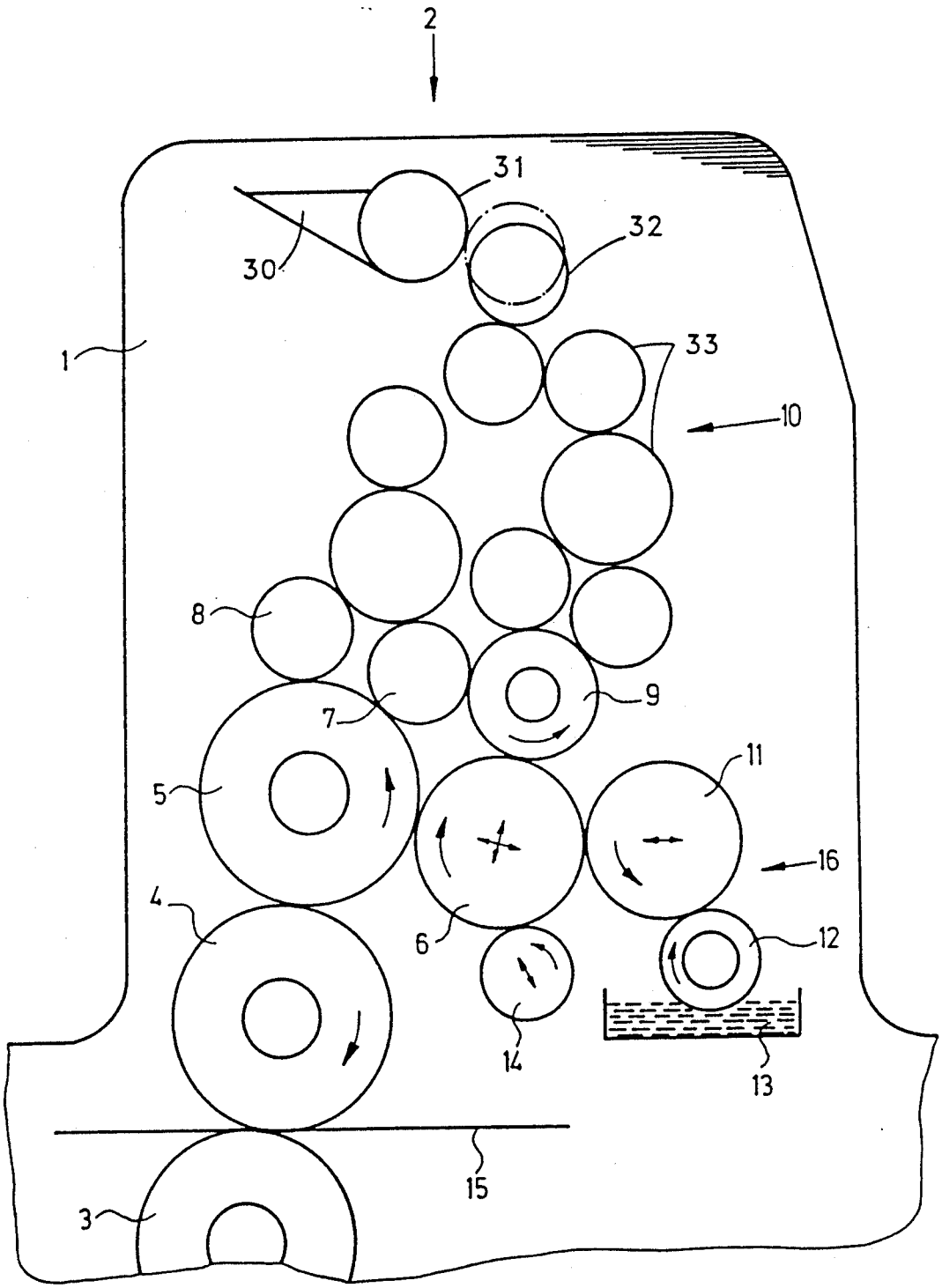
FIG. 2 is a side view of another printing mechanism having a wetting/inking mechanism configured according to another embodiment of the present invention.

Referring now to FIG. 2, between the side frames 1 of a printing unit 2, there is provided a printing cylinder 3, a blanket cylinder 4, and a plate cylinder 5. Corresponding to the plate cylinder 5 there are provided applicator rolls 6, 7 and 8, applicator rolls 6 and 7 of which are connected to one another by means of an ink distributor roller 9. The applicator rolls 6 and 8 receive the required amount of ink, in a manner well known in the prior art, by means of an inking mechanism 10.

The inking mechanism 10 generally includes an ink reservoir (or ink duct) 30, a duct or roller 31, a vibrator roller 32 and a plurality of transfer rollers, two of such plurality of transfer rollers being indicated by reference numeral 33. Vibrator roller 32 oscillates between the two positions shown, picking up stripes of ink from duct or roller 31 and transferring them to at least one of the plurality of transfer rollers 33. The ink is then transferred downward through the plurality of transfer rollers 33 toward the applicator rollers, e.g., 6, 7 and 8. A typical inking mechanism of this type is shown in U.S. Pat. No. 4,660,470 entitled "Inking Unit Pre-Adjustment Method" and issued on Apr. 28, 1987 to Kramp, et al., which patent is incorporated herein by reference as if the entire contents thereof were fully set forth herein.

The first applicator roll (seen in the direction of rotation of the plate cylinder 5) has a doser roller 11, which is mounted so that it can move toward the applicator roll 6. Wetting agent in a wetting agent tank 13 is transported to a doser roller 11 by means of a dip roller 12. Another wetting roller (or distributor roller) 14 with a chromium jacket surface can be selectively moved toward or away from the first applicator roll 6. Such a printing unit 2 can be used to print either sheets or webs 15.

Figure 3:
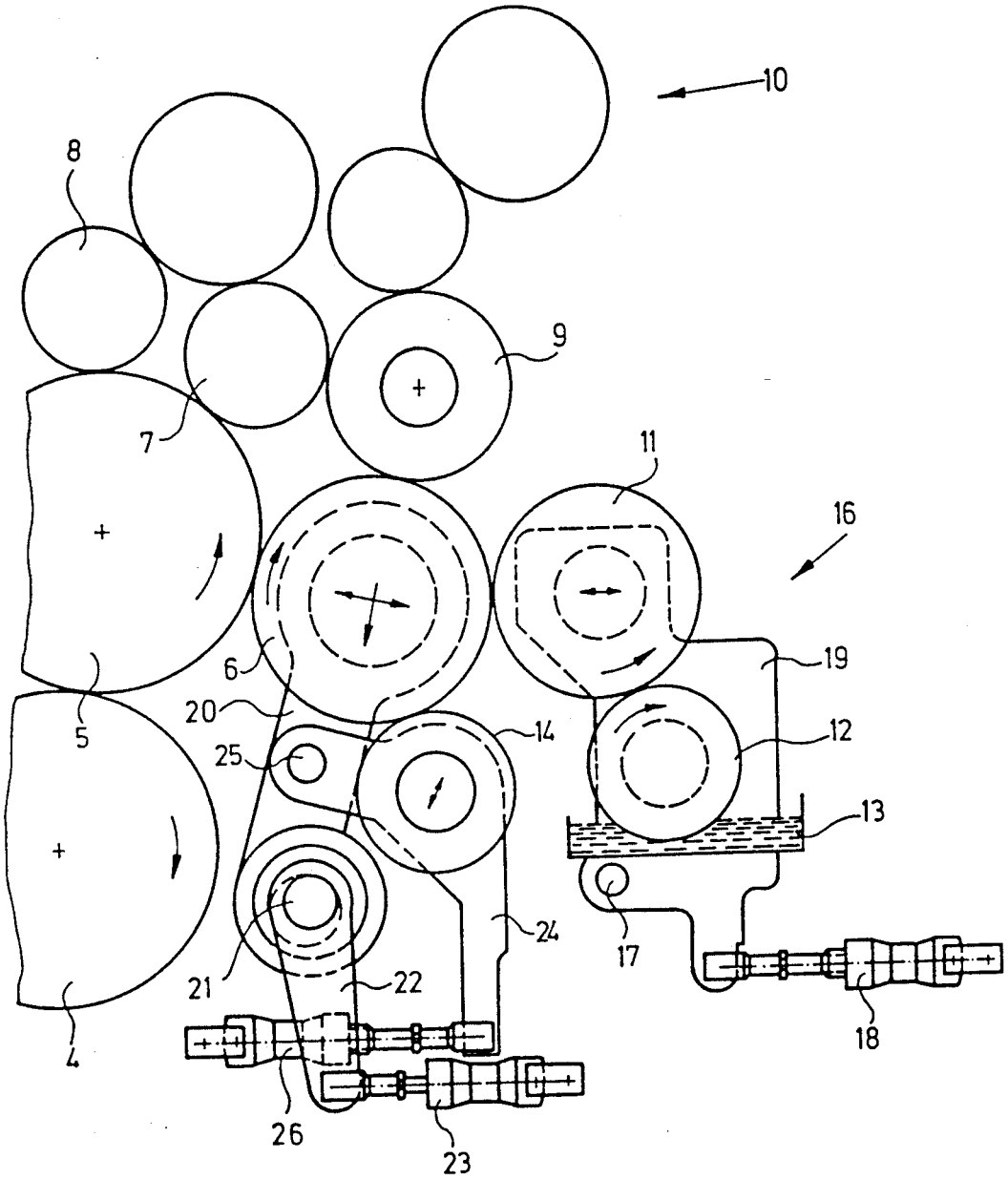
FIG. 3 shows the wetting/inking mechanism of FIG. 1 with the applicator roll in a first position.

FIG. 3 shows the wetting mechanism 16, in which the dosing roller 11 and the dip roller 12 are mounted so that they can pivot around a pivot 17, the pivoting being actuated by means of a pneumatic or hydraulic cylinder 18. As a result of the pivoting, the dosing roller 11 can be moved toward or away from the first applicator roll 6, as required, for example, to start or stop printing. The side parts 1 to hold the dosing roller 11 and the dip roller 12 are located between the side frames 1 of the printing unit 2 on both sides.

Applicator roll 6 can pivot on both sides on a lever pair 20, so that it can be moved toward and away from the plate cylinder 5, initially to start and stop printing. By means of eccentric pivots 21 and levers 22, which are connected to the pivot 21, the eccentric pivots can be pivoted by means of a pneumatically or hydraulically operated cylinder 23 so that the first applicator roll 6 is moved toward the ink distributor roller 9, as shown in FIG. 3, or away from it, as shown in FIG. 4.

Figure 4:
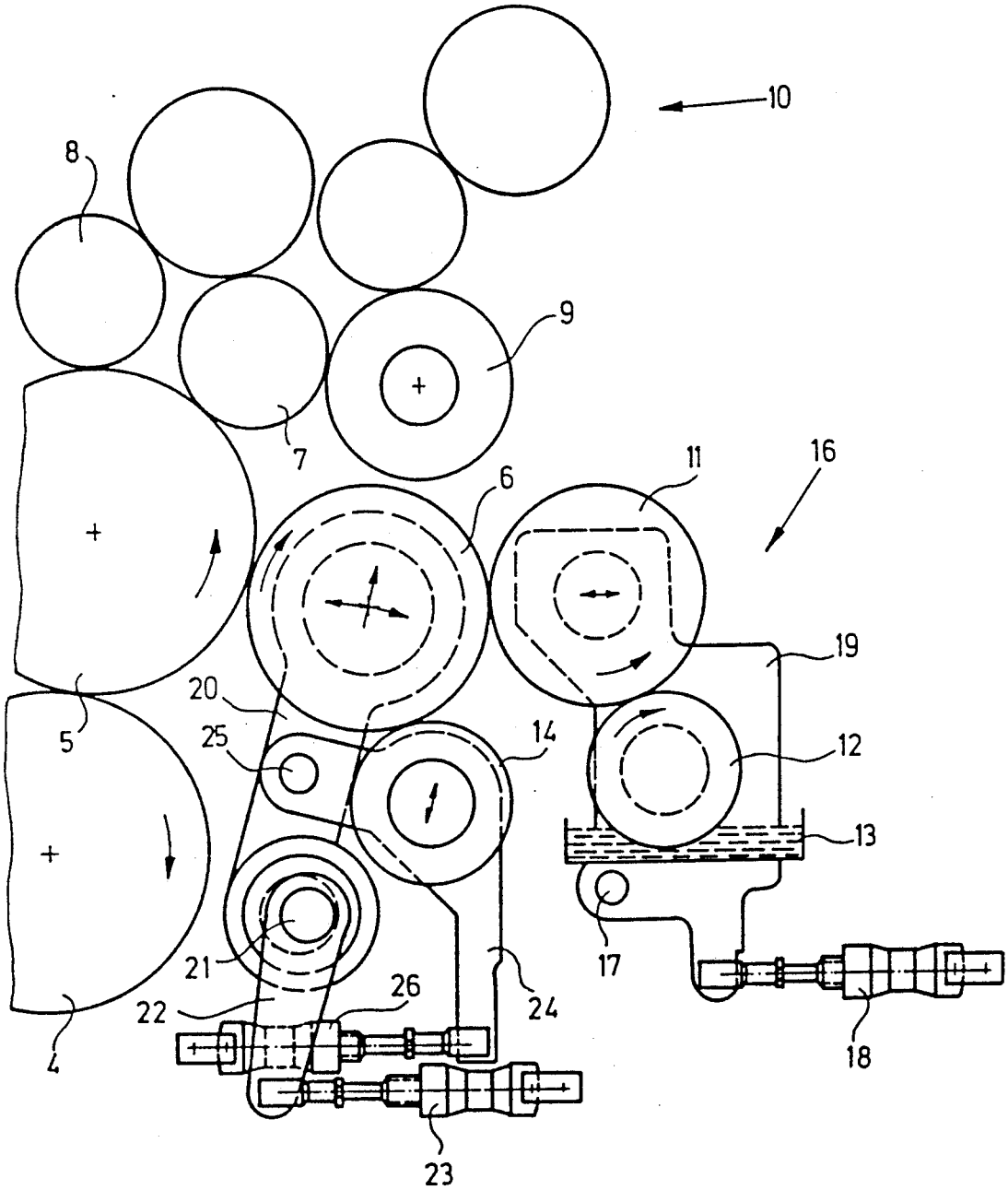
FIG. 4 shows the wetting/inking mechanism of FIG. 1 with the applicator roll in a second position.

Eccentric pivots 21 (there preferably being two, only one of which is visible in the direct side view of FIGS. 3 and 4) are prior art devices which are well known in the mechanical design arts. Essentially they are eccentric cams which convert a lateral movement of the piston rod of pneumatic cylinder 23 into an up and down movement of lever pair 20 and applicator roller 6 which is generally transverse to the lateral movement of the piston rod of pneumatic cylinder 23. Although not shown, other selective positioning means could readily be substituted for eccentric pivots 21, lever arms 22 and pneumatic cylinder 23. For example, a direct push-pull mechanism, such as a pneumatic cylinder can be mounted in-line with or along the longitudinal axis of lever pair 20 so as to effect a direct longitudinal shifting thereof.

In the preferred embodiment shown, the barrel of pneumatic cylinder 23 is secured in a stationary position, for example, by bolting to a portion of the stationary side frame. Accordingly, with the barrel of pneumatic cylinder so secured, and through the action of eccentric pivots (or cams) 21, shifting of the piston rod of pneumatic cylinder 23 between its retracted and expanded positions will result in a shifting of applicator roller 6 between the positions shown in FIGS. 3 and 4, respectively.

Mounted on the lever pair 20, by means of pivots 25, is a second lever pair 24. Mounted in the second lever pair 24 is the wetting roller 14, which in turn can be pivoted by means of a hydraulic or pneumatic cylinder 26 toward or away from the first applicator roll 6. Pneumatic cylinder 26 may be mounted within printing unit 2 in a manner similar to pneumatic cylinder 23 discussed above. By means of the matte chromium jacket surface of the wetting roller 14, it is thereby possible to smooth out the wetting agent film on the applicator roll 6, if such a smoothing is advantageous for certain printing jobs.

Lever pairs 20 and 24 are each a pair of spaced lever arms, with applicator roller 6 being rotatably mounted between lever pair 20, end with wetting roller 14 being rotatably mounted between lever pair 24. In FIGS. 3 and 4 only one lever arm is plainly visible for each of lever pairs 20 and 24, since the second not visible lever arm is positioned directly behind.

Pneumatic (or hydraulic) cylinders, such as pneumatic cylinders 18, 23 and 26 herein, are conventional and well-known mechanical components with which one of ordinary skill in the art of printing press design is familiar. An example of prior art in which pneumatic cylinders are used in the printing press field to selectively shift mechanical components is to be found in U.S. Pat. No. 4,711,172 entitled "Machine Having a Plurality of Working Stations for Successively Processing a Sheet of Material Running Through the Machine" and issued on Dec. 8, 1987 to Capdebosc, which patent is incorporated herein by reference as if the entire contents thereof were fully set forth herein.

As shown in FIG. 3, with the first applicator roll 6 in contact with the driven ink distributor roller 9, printing can be done with contact between the inking and wetting mechanism. Very small formats or very narrow webs can be printed in this configuration, without worrying about the formation of an emulsion in the inking mechanism, if no ink is required in certain areas.

In the configuration illustrated in FIG. 4, in which the first applicator roller 6 is moved away from the ink spreader roller 9, the wetting mechanism works without contact with the inking mechanism, and is used exclusively to transfer wetting agent to the printing plate. The first applicator roll 6 is here used as a pure wetting agent applicator roll and can execute an additional distributing movement (e.g., oscillation) in the axial direction. There are known methods for causing a roller of a printing press to ocillate in an axial direction, one of which is described in U.S. Pat. No. 3,118,373, issued to Mosemiller on Jan. 21, 1964 and entitled "Inker", which U.S. patent is incorporated herein by reference as if the entire contents thereof were fully set forth herein. In this configuration, buildup of ink in the direction of travel is reduced, so that the printing press operator can adjust the wetting/inking mechanism to his printing requirements without a great deal of effort, and can thereby achieve optimum results.

In general, the invention features a mechanism for applying a wetting agent or ink in a printing press, the printing press including a plate cylinder, an ink reservoir and an ink transfer apparatus for transferring the ink from the ink reservoir to the plate cylinder, the ink transfer apparatus including at least a first applicator roller which receives ink from the ink reservoir, the first applicator roller being in contact with the plate cylinder, and a distributor roller, the mechanism including a second applicator roller, a wetting agent reservoir, a wetting agent transfer apparatus for transferring the wetting agent from the wetting agent reservoir to the second applicator roller, and a selective shifting apparatus for selectively shifting the second applicator roller between a first position wherein it contacts both the plate cylinder and the distributor roller and a second position wherein it contacts the plate cylinder but is not in contact with the distributor roller.

In summary, one feature of the invention resides broadly in a roller in a printing unit of a rotary printing machine, the entire outer cylindrical surface of the roller featuring a uniform roughness characterized in that, seen in direction of rotation of a plate cylinder 4',5', said roller 14' is mounted so as to be engageable at a last dampening-medium applicator roller 7' and a first ink applicator roller 8' and has an outer cylindrical surface, which is preferably made of copper and is designed so as to feature a roughness ranging from 15 to 20 micrometer.

Another feature of the invention resides broadly in a roller which is characterized in that the outer cylindrical surface of the roller 14' is galvanically roughened and consists preferably of ink-receptive material.

Some examples of components of printing presses can be found in U.S. Pat. No. 4,481,882, entitled "Device For Adjusting Ink Or Moisture-Application Rolls", U.S. Pat. No. 4,290,360, entitled "Selective In And Wetting Liquid, Or Wetting Liquid Only, Application System For Offset Printing Presses"; U.S. Pat. No. 3,983,812, entitled "Inking System On Printing Presses Having Provision For Varying Ink Distribution Peripherally On Printing Plate"; U.S. Pat. No. 3,688,694, entitled "Dampening Device For A Printing Press"; U.S. Pat. No. 4,440,081, entitled "Dampening-Inking Unit For Offset Printing Machines"; U.S. Pat. No. 4,524,690, entitled "Water Supply Apparatus For Printing Press", U.S. Pat. No. 3,749,011, entitled "Damping Device For Lithographic Printing Presses"; U.S. Pat. No. 4,660,470, entitled "Inking Unit Pre-Adjustment Method"; U.S. Pat. No. 4,711,172, entitled "Machine Having A Plurality Of Working Stations For Successively Processing A Sheet Of Material Running Through The Machine"; U.S. Pat. No. 4,440,081, entitled "Dampening-Inking Unit For Offset Printing Machines" and Federal Republic of Germany Patent Publication No. 29 32 105.

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A printing press for printing a document comprising:

first plate cylinder means;

first ink applicator roller means for being in contact with said first plate cylinder means and for applying an ink to said plate cylinder means;

wetting application roller means for being in contact with said first plate cylinder means and for applying a wetting agent to said plate cylinder means; and first roller means for being in contact with at least one of said first ink applicator roller means and said wetting medium application roller means;

said first roller means for distributing at least one of said wetting agent and said ink;

said first roller means defining an exterior surface having a generally uniform roughness over generally all portions of the entire exterior surface of said first roller means;

said generally uniform roughness being in the range of fifteen micrometers to twenty micrometers, whereby at least one of ghosting and scumming is reduced.

2. The printing press of claim 1, wherein said exterior surface of said first roller means comprises an ink receptive material.

3. The printing press of claim 2, wherein said first roller means comprises a galvanically roughened surface.

4. The printing press of claim 3, wherein said exterior surface of said first roller means is at least one member selected from the group consisting essentially of: a) copper, b) bronze and c) brass.

5. Apparatus for distributing at least one of a wetting agent and an ink in a printing press having at least a first plate cylinder means, at least a first ink applicator roller means in contact with the first plate cylinder means and at least one wetting agent application roller means in contact with the first plate cylinder means, said apparatus for distributing at least one of a wetting agent and an ink comprising:

first roller means for being in contact with at least one of said at least one ink applicator roller and said at least one wetting agent application roller means;

said first roller means for distributing at least one of said wetting agent and said ink;

said first roller means defining an exterior surface having a generally uniform roughness over generally all portions of the entire exterior surface of said first roller means; and said generally uniform roughness being in the range of fifteen micrometers to twenty micrometers.

6. The apparatus of claim 5, wherein said exterior surface of said first roller means comprises an ink receptive material.

7. The apparatus of claim 6, wherein said first roller means comprises a galvanically roughenend surface.

8. The apparatus of claim 7, wherein said exterior surface of said first roller means is at least one member selected from the group consisting essentially of: a) copper, b) bronze and c) brass.

9. The printing press of claim 4, further including:

ink fountain means for supplying said ink;

fountain roller means in fluid communication with said ink fountain means, said fountain roller means for receiving said ink from said ink fountain means;

second roller means for distributing said ink from said ink fountain means;

third roller means for being in at least periodic contact with at least one of said fountain roller means and said second roller means, said third roller means for receiving said ink from said fountain roller means and supplying said ink to said second roller means;

fourth roller means for being in contact with said second roller means, said fourth roller means for receiving said ink from said second roller means;

fifth roller means for being in contact with said fourth roller means, said fifth roller means for receiving said ink from said fourth roller means;

sixth roller means for being in contact with said fifth roller means, said sixth roller means for receiving said ink from said fifth roller means;

seventh roller means for being in contact with said sixth roller means, said seventh roller means for receiving said ink from said sixth roller means;

eighth roller means for being in contact with said seventh roller means, said eighth roller means for receiving said ink from said seventh roller means;

ninth roller means for being in contact with said eighth roller means, said ninth roller means for receiving said ink from said eighth roller means;

second ink applicator roller means for being in contact with said ninth roller means and said first plate cylinder means, said second ink applicator roller means for receiving said ink from said ninth roller means and applying said ink to said first plate cylinder means;

third ink application roller means for being in contact with said ninth roller and said first plate cylinder means, said third ink applicator roller means for receiving ink from said ninth roller means and applying said ink to said first plate cylinder means;

tenth roller means for being in contact and for rotating with said third ink applicator roller means;

eleventh roller means for being in contact with said fifth roller means, said eleventh roller means for receiving ink from said fifth roller means;

twelfth roller means for being in contact with said sixth roller means and said eleventh roller means, said twelfth roller means for receiving ink from said sixth roller means and from said eleventh roller means;

said first ink applicator roller means for being in contact with said twelfth roller means, said first roller means and said first plate cylinder means for supplying at least one of said ink and said wetting agent to said plate cylinder means;

said wetting application roller means for being in contact with said first roller means and said plate cylinder means, said wetting application roller means for supplying at least one of said ink and said wetting agent to said plate cylinder means;

wetting agent tank means for supplying said wetting agent;

thirteenth roller means for being in contact with said wetting application roller means, said thirteenth roller means for supplying said wetting agent to said wetting agent application roller means;

fourteenth roller means for being in contact with said thirteenth roller means, said fourteenth roller means for supplying said wetting agent to said thirteenth roller means;

fifteenth roller means in fluid communication with said wetting agent tank and said fourteenth roller means, said fifteenth roller means for receiving said wetting agent from said wetting agent tank and supplying said wetting agent to said fourteenth roller means;

first blanket cylinder means for being in contact with said plate cylinder means, said blanket cylinder means for receiving at least one of said ink and said wetting agent from said plate cylinder means and for printing the document;

second blanket cylinder means positioned adjacent said first blanket cylinder means, said second blanket cylinder means for printing the document;

second plate cylinder means for being in contact and rotating with said blanket cylinder means;

sixteenth roller means for being in contact and rotating with said second plate cylinder means;

seventeenth roller means for being in contact and rotating with said second plate cylinder means;

eighteenth cylinder means for being in contact and rotating with said second plate cylinder means;

nineteenth cylinder means for being in contact and rotating with said second plate cylinder means; and twentieth roller means for being in contact and rotating with said nineteenth roller means.

10. The apparatus of claim 8, further including:

ink fountain means for supplying said ink;

fountain roller means in fluid communication with said ink fountain means, said fountain roller means for receiving said ink from said ink fountain means;

second roller means for distributing said ink from said ink fountain means;

third roller means for being in at least periodic contact with at least one of said fountain roller means and said second roller means, said third roller means for receiving said ink from said fountain roller means and supplying said ink to said second roller means;

fourth roller means for being in contact with said second roller means, said fourth roller means for receiving said ink from said second roller means;

fifth roller means for being in contact with said fourth roller means, said fifth roller means for receiving said ink from said fourth roller means;

sixth roller means for being in contact with said fifth roller means, said sixth roller means for receiving said ink from said fifth roller means;

seventh roller means for being in contact with said sixth roller means, said seventh roller means for receiving said ink from said sixth roller means;

eighth roller means for being in contact with said seventh roller means, said eighth roller means for receiving said ink from said seventh roller means;

ninth roller means for being in contact with said eighth roller means, said ninth roller means for receiving said ink from said eighth roller means;

second ink applicator roller means for being in contact with said ninth roller means and said first plate cylinder means, said second ink applicator roller means for receiving said ink from said ninth roller means and applying said ink to said first plate cylinder means;

third ink applicator roller means for being in contact with said ninth roller and said first plate cylinder means, said third ink applicator roller means for receiving ink from said ninth roller means and applying said ink to said first plate cylinder means;

tenth roller means for being in contact and for rotating with said third ink applicator roller means;

eleventh roller means for being in contact with said fifth roller means, said eleventh roller means for receiving ink from said fifth roller means;

twelfth roller means for being in contact with said sixth roller means and said eleventh roller means, said twelfth roller means for receiving ink from said sixth roller means and from said eleventh roller means;

said first ink applicator roller means for being in contact with said twelfth roller means, said first roller means and said first plate cylinder means for supplying at least one of said ink and said wetting agent to said plate cylinder means;

said wetting application roller means for being in contact with said first roller means and said plate cylinder means, said wetting application roller means for supplying at least one of said ink and said wetting agent to said plate cylinder means;

wetting agent tank means for supplying said wetting agent;

thirteenth roller means for being in contact with said wetting application roller means, said thirteenth roller means for supplying said wetting agent to said wetting agent application roller means;

fourteenth roller means for being in contact with said thirteenth roller means, said fourteenth roller means for supplying said wetting agent to said thirteenth roller means;

fifteenth roller means in fluid communication with said wetting agent tank and said fourteenth roller means, said fifteenth roller means for receiving said wetting agent from said wetting agent tank and supplying said wetting agent to said fourteenth roller means;

first blanket cylinder means for being in contact with said plate cylinder means, said blanket cylinder means for receiving at least one of said ink and said wetting agent from said plate cylinder means and for printing the document;

second blanket cylinder means positioned adjacent said first blanket cylinder means, said second blanket cylinder means for printing the document;

second plate cylinder means for being in contact and rotating with said blanket cylinder means;

sixteenth roller means for being in contact and rotating with said second plate cylinder means;

seventeenth roller means for being in contact and rotating with said second plate cylinder means;

eighteenth cylinder means for being in contact and rotating with said second plate cylinder means;

nineteenth cylinder means for being in contact and rotating with said second plate cylinder means; and twentieth roller means for being in contact and rotating with said nineteenth roller means.

11. A printing press for printing a document comprising:

first plate cylinder means;

first ink appliator roller means for being in contact with said first plate cylinder means and for applying an ink to said plate cylinder means;

wetting application roller means for being in contact with said first plate cylinder means and for applying a wetting agent to said plate cylinder means; and first roller means for being in contact with at least one of said first ink applicator roller means and said wetting medium application roller means;

said first roller means for distributing at least one of said wetting agent and said ink;

said first roller means defining an exterior surface having a generally uniform roughness over generally all portions of the entire exterior surface of said first roller means;

said generally uniform roughness being in the range of fifteen micrometers to twenty micrometers.

12. The printing press of claim 11, wherein said exterior surface of said first roller means comprises an ink receptive material.

13. The printing press of claim 12, wherein said first roller means comprises a galvanically roughened surface.

14. The printing press of claim 13, wherein said exterior surface of said first roller means is at least one member selected from the group consisting essentially of: a) copper, b) bronze and c) brass.

15. The printing press of claim 14, further including:

ink fountain means for supplying said ink;

fountain roller means in fluid communication with said ink fountain means, said fountain roller means for receiving said ink from said ink fountain means;

second roller means for distributing said ink from said ink fountain means;

third roller means for being in at least periodic contact with at least one of said fountain roller means and said second roller means, said third roller means for receiving said ink from said fountain roller means and supplying said ink to said second roller means;

fourth roller means for being in contact with said second roller means, said fourth roller means for receiving said ink from said second roller means;

fifth roller means for being in contact with said fourth roller means, said fifth roller means for receiving said ink from said fourth roller means;

sixth roller means for being in contact with said fifth roller means, said sixth roller means for receiving said ink from said fifth roller means;

seventh roller means for being in contact with said sixth roller means, said seventh roller means for receiving said ink from said sixth roller means;

eighth roller means for being in contact with said seventh roller means, said eighth roller means for receiving said ink from said seventh roller means;

ninth roller means for being in contact with said eighth roller means, said ninth roller means for receiving said ink from said eighth roller means;

second ink applicator roller means for being in contact with said ninth roller means and said first plate cylinder means, said second ink applicator roller means for receiving said ink from said ninth roller means and applying said ink to said first plate cylinder means;

third ink applicator roller means for being in contact with said ninth roller and said first plate cylinder means, said third ink applicator roller means for receiving ink from said ninth roller means and applying said ink to said first plate cylinder means;

tenth roller means for being in contact and for rotating with said third ink applicator roller means;

eleventh roller means for being in contact with said fifth roller means, said eleventh roller means for receiving ink from said fifth roller means;

twelfth roller means for being in contact with said sixth roller means and said eleventh roller means, said twelfth roller means for receiving ink from said sixth roller means and from said eleventh roller means;

said first ink applicator roller means for being in contact with said twelfth roller means, said first roller means and said first plate cylinder means for supplying at least one of said ink and said wetting agent to said plate cylinder means;

said wetting application roller means for being in contact with said first roller means and said plate cylinder means, said wetting application roller means for supplying at least one of said ink and said wetting agent to said plate cylinder means;

wetting agent tank means for supplying said wetting agent;

thirteenth roller means for being in contact with said wetting application roller means, said thirteenth roller means for supplying said wetting agent to said wetting agent application roller means;

fourteenth roller means for being in contact with said thirteenth roller means, said fourteenth roller means for supplying said wetting agent to said thirteenth roller means;

fifteenth roller means in fluid communication with said wetting agent tank and said fourteenth roller means, said fifteenth roller means for receiving said wetting agent from said wetting agent tank and supplying said wetting agent to said fourteenth roller means;

first blanket cylinder means for being in contact with said plate cylinder means, said blanket cylinder means for receiving at least one of said ink and said wetting agent from said plate cylinder means and for printing the document;

second blanket cylinder means positioned adjacent said first blanket cylinder means, said second blanket cylinder means for printing the document;

second plate cylinder means for being in contact and rotating with said blanket cylinder means;

sixteenth roller means for being in contact and rotating with said second plate cylinder means;

seventeenth roller means for being in contact and rotating with said second plate cylinder means;

eighteenth cylinder means for being in contact and rotating with said second plate cylinder means;

nineteenth cylinder means for being in contact and rotating with said second plate cylinder means; and twentieth roller means for being in contact and rotating with said nineteenth roller means.

* * * * *